United States Patent [19]

Mott et al.

[11] Patent Number: 4,575,082

[45] Date of Patent: Mar. 11, 1986

[54] RACQUET WITH RATCHET-CONNECTED THROAT AND HANDLE

[75] Inventors: Jonathan C. Mott, Honiton, England; Robert C. Kelley, Opelika, Ala.

[73] Assignee: Diversified Products Corporation, Opelika, Ala.

[21] Appl. No.: 573,494

[22] Filed: Jan. 24, 1984

[51] Int. Cl.[4] ..... A63B 49/08

[52] U.S. Cl. ..... 273/73 G; 273/73 J; 273/73 H

[58] Field of Search ..... 273/75, 73 J, 73 E, 273/73 G; 16/114 R, 115; 403/105, 211, 374

[56] References Cited

U.S. PATENT DOCUMENTS

| | | | |
|---|---|---|---|
| 3,642,283 | 2/1972 | Wilkens | 273/73 G |
| 3,931,968 | 1/1976 | Hedberg | 273/73 J X |
| 4,099,716 | 7/1978 | Haddad | 273/73 E |
| 4,149,721 | 4/1979 | Strickland | 273/73 J |

FOREIGN PATENT DOCUMENTS

| | | | |
|---|---|---|---|
| 2480241 | 10/1981 | France | 16/114 R |
| 178694 | 4/1922 | United Kingdom | 273/73 J |
| 233544 | 5/1925 | United Kingdom | 273/73 E |

*Primary Examiner*—William H. Grieb
*Assistant Examiner*—Matthew L. Schneider
*Attorney, Agent, or Firm*—Banner, Birch, McKie & Beckett

[57] ABSTRACT

A racquet formed from a frame defining a head portion and merging into two end portions that constitute a handle portion. A throat member is located adjacent the merging portions. The throat member has an extension with ratchet teeth located thereon that fits between the end portions of the frame. A handle grip having interiorly located ratchet teeth fits over the end portions of the frame and the extension on the throat member. The ratchet teeth on the throat extension and the handle grip matingly engage so as to provide a secure connection between the two.

10 Claims, 8 Drawing Figures

RACQUET WITH RATCHET-CONNECTED THROAT AND HANDLE

This invention relates to racquets, and is more particularly but not exclusively concerned with tennis and racquet-ball racquets having an extruded aluminium frame.

One well-known type of tennis or racquet-ball racquet comprises a substantially oval frame made from a single length of extruded aluminium tubing. The tubing is bent to form the oval shape of the frame, and has its opposite ends extending beside and parallel to each other from one end of the major axis of the oval shape of the frame to form the basis or foundation of the handle of the racquet. The handle is completed by a suitably shaped sleeve, which slides over and is bonded to the parallel ends of the tubing, while the oval shape of the frame is completed by a throat member, which is secured between the parallel ends of the tubing at the point where they begin to diverge to form the oval shape.

It is an object of the present invention to provide an improved racquet of this general type.

According to the invention, a racquet comprises:

an elongate hollow tube, having a central portion which is curved to form the greater part of the circumference of the frame of the racquet, and two end portions which extend substantially parallel to and adjacent each other to form the basis of a handle for the racquet;

a throat member disposed between said end portions of the tube where they respectively join said central portion, whereby said throat member forms the remainder of the circumference of the frame of the racquet;

stringing secured to said central portion of the tube and to said throat member, within the frame formed thereby; and a handle member which fits over said end portions of the tube to hold them together and further define the handle of the racquet;

wherein the throat member is provided with a projecting portion which projects therefrom between the end portions of the tube and into the handle member, said projecting portion and said handle member being provided with co-operating teeth which are shaped to permit the handle member to be pushed over the end portions of the tube and said projecting portion towards the throat member, and to lock the handle member against withdrawal therefrom.

Thus the co-operating teeth on the projecting portion of the throat member and on the handle member together produce a kind of ratchet action, which locks the handle member on the end portions of the tube and tends to pull the throat member down between these end portions. This considerably enhances the structural integrity of the racquet.

In a preferred embodiment of the invention, a longitudinal groove is provided in the part of the external surface of the tube which defines the internal periphery of the frame and the facing surfaces of the end portions of the tube, and the sides of the throat member adjacent these facing surfaces are each provided with at least one projecting tab which engages in this groove.

Thus the pulling effect resulting from the aforementioned ratchet action tends to lock these tabs more firmly in the groove.

The invention will now be described, by way of example only, with reference to the accompanying drawings, of which:

Figure 1:
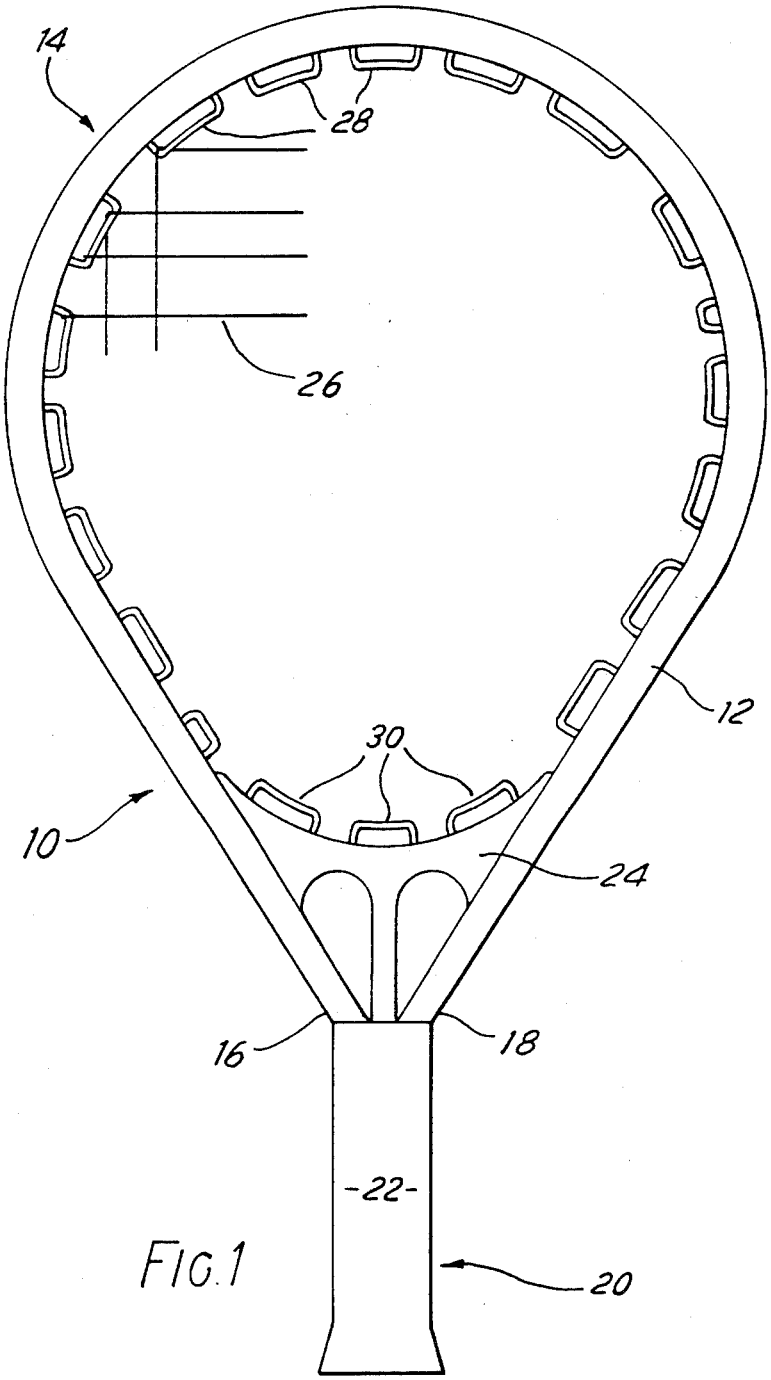
FIG. 1 shows a racquet in accordance with the present invention.

The racquet-ball racquet illustrated in FIG. 1 is indicated generally at 10, and comprises an approximately oval frame 12 made from a single length of extruded aluminum tubing 14, which is bent to form the oval shape of the frame. The opposite ends 16, 18 of the tubing 14 extend beside and parallel to each other from one end of the major axis of the oval shape of the frame, to form the basis of a handle 20. A plastics handle member 22 fits over the ends 16, 18 of the tubing 14, to secure them together and further define the handle 20, while a plastics throat member 24 is secured between the ends 16, 18 of the tubing 14, at the point where they begin to diverge to form the oval shape of the frame 12, in order to complete the oval shape. The handle member 22 and the throat member 24 co operate in a manner which will be described in more detail hereinafter with reference to FIGS. 2 to 8. The handle 20 of the racquet 10 is completed by covering the handle member 221 with a layer or layers of material whose surface is suitable for gripping, or is covered with a material suitable for gripping, such as leather.

The racquet 10 also comprises stringing, which is indicated generally at 26 in FIG. 1 and is composed of nylon, gut or other suitable stringing material. The individual strings of the stringing 26 are secured to the frame 121 by passing them through respective wire string-securing loops, such as those indicated at 28 and 30, which project into the oval space enclosed by the frame 12 from the radially inner surface of the frame. As can be seen in FIG. 1, the loops 28 project into the space within the frame 12 from the tubing 14; they are formed from a single, suitably-bent, piece of wire, which is secured in a dovetail-section groove in the tubing substantially as described in UK Patent Publication No. 2,136,300. Similarly, the loops 30 project into the space within the frame 12 from the throat member 24, and are preferably moulded into the throat member as described in UK Patent Application No. 83 27851.

Figure 2:
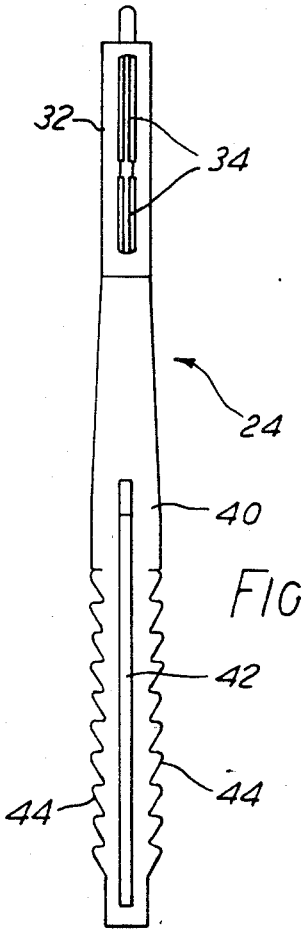
FIG. 2 is a side view of a throat member forming part of the racquet of FIG. 1.
Figure 3:
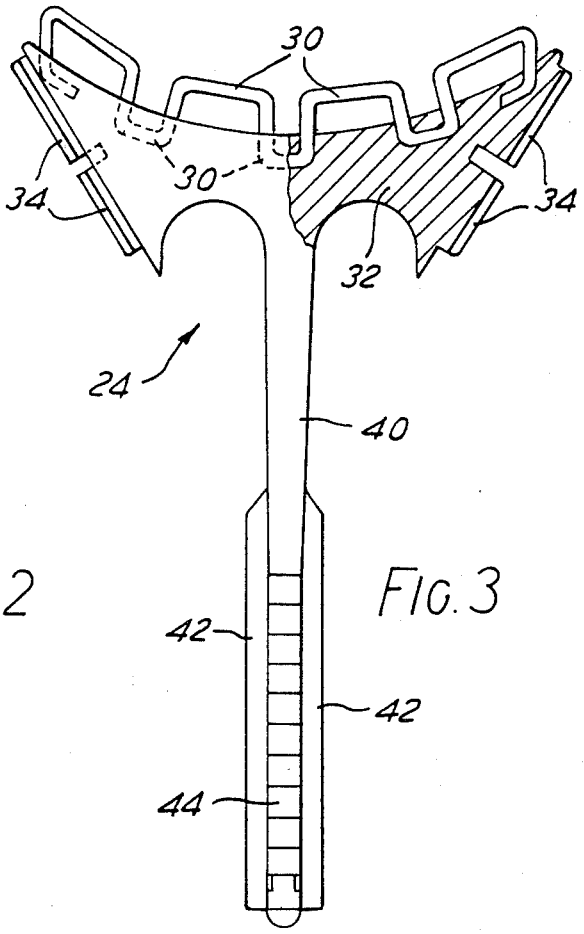
FIG. 3 is a plan view, partly in section, of the throat member of FIG. 2.
Figure 4:
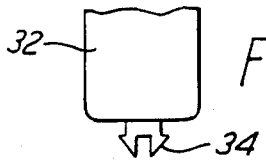
FIG. 4 is a view of a detail of the throat member of FIG. 2.
Figure 5:
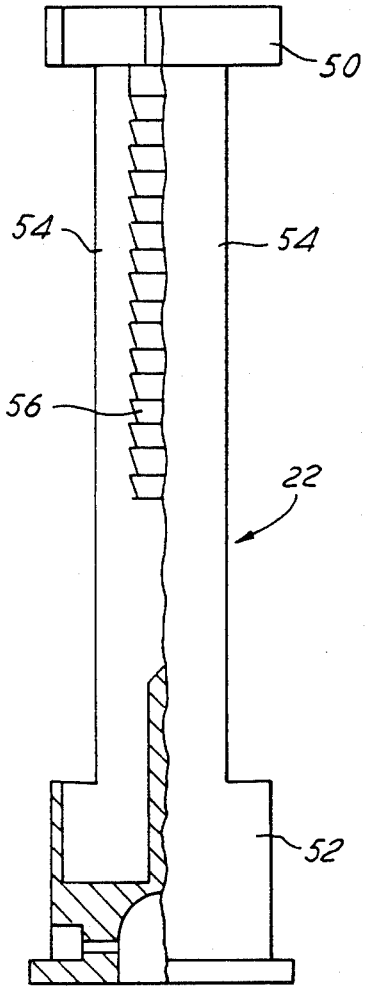
FIG. 5 is a plan view, partly in section, of part of the handle of the racquet of FIG. 1.
Figure 6:
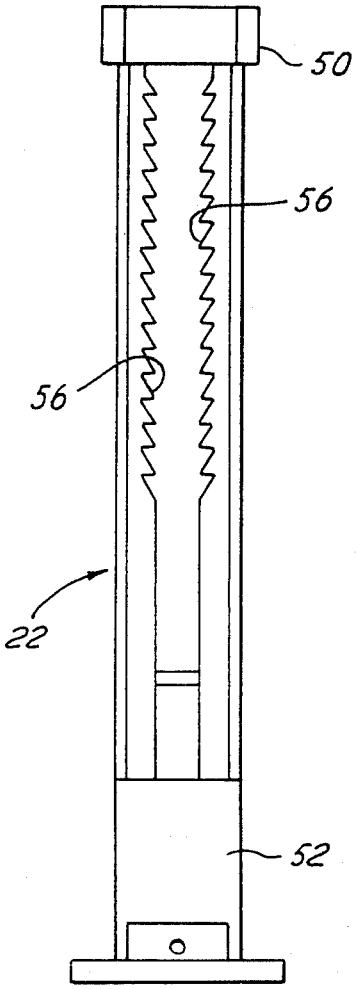
FIG. 6 is a side view of the handle part of FIG. 5.
Figure 7:
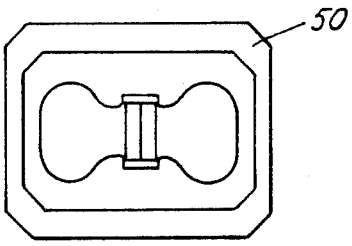
FIGS. 7 and 8 are views of the opposite ends of the handle part of FIGS. 5 and 6.
Figure 8:
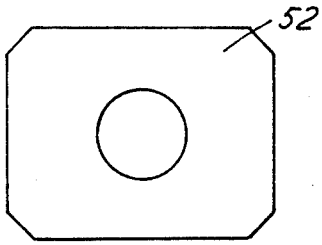

The plastics throat member 24 is shown in more detail in FIGS. 2 to 4, from which it can be seen that the throat member comprises a main body 32, which is shaped to slot into the V-shaped space defined between the portions of the tubing 14 at the point where they begin to diverge from the end portions 16, 18 to define the oval shape of the frame. The sides of the body 32 are provided with projecting tabs 34, which are slotted (to make them resiliently compressible) and barbed, as shown in FIG. 4, so that they can be pushed into, and can lock in, the aforementioned dovetail-shaped groove in the tubing 14. The loops 30 projecting from the throat member 24 are also formed from a single, suitably-bent, piece of wire, which is moulded into the body 32 as shown at 36.

Projecting downwardly from the centre of the throat member 24, parallel to and between the ends 16, 18 of the tubing 14, is an integrally-moulded elongate double ratchet member 40 of approximately rectangular cross-section. The two opposite sides of the ratchet member 40 which face respective ones of the ends 16, 18 of the tubing 14 are provided with identical elongated projecting tabs 42, which engage in the aforementioned dovetail-shaped groove in the tubing. The other two opposite sides of the ratchet member 40, ie the two sides which face perpendicularly away from the plane of the racquet 10, are provided with respective identical linear arrays of ratchet teeth 44, which are inclined (or biassed) towards the main body 32 of the throat member 24.

The plastics handle member 22 is shown in more detail in FIGS. 5 to 8. As can be seen in these Figures, the handle member 22 comprises an annular flange 50 shaped to be a sliding fit over the ends 16, 18 of the tubing 14, an end socket 52 axially aligned with the flange 50 and shaped to receive the ends 16, 18 of the tubing 14, and two parallel connecting members 54 which are moulded integrally with the flange 50 and the end socket 52, and serve to connect them together and hold them in alignment. The inner surfaces of the connecting members 54 face into the space between the ends 16, 18 of the tubing 14 from the opposite sides of this space, and are provided with respective linear arrays of ratchet teeth 56. The tooth arrays 56 extend parallel to and are aligned with the tooth arrays 44 on the ratchet member 40 of the throat member 24, and the teeth 56 and 44 are complementary to each other.

In use, the handle member 22 is fitted to the remainder of the racquet 10 by fitting the flange 50 over the ends 16, 18 of the tubing 14 and the extremity of the ratchet member 40 on the throat 24. As the handle member 22 is pushed further onto the ends 16, 18 of the tubing 14, the extremity of the ratchet member 40 enters the space between the connecting members 54, and the teeth 56 on the latter start to slide in a ratchet-like manner over the teeth 44 on the former. The further the handle member 22 is pushed onto the ends 16, 18 of the tubing 14, the more the teeth 56 become engaged with the teeth 44, thus locking the handle member 22 in a progressively more firm manner against withdrawal from the ends 16, 18 of the tubing. The handle member 22 is pushed home until the extremities of the ends 16, 18 of the tubing 14 are fully received in the socket 52, at which point the teeth 44 and 56 are fully engaged. The handle 20 of the racquet 10 is then completed as described earlier.

It will be appreciated that the interlocking of the handle member 22 and the throat member 24 produces a very strong racquet. Thus the throat member is very firmly locked in its proper position between the ends 16, 18 of the tubing 14 at the point where they begin to diverge. Similarly, the handle 20 is very firmly locked in its proper position on the ends 16, 18 of the tubing 14. The handle member 22 and the throat member 24 therefore provide a self-locking and self-locating form of construction for the racquet 10. Furthermore, this construction requires no holes at all to be provided in the tubing 14 for the securing of the handle member 22 and the throat member 24 thereto.

Many modifications can be made to the described embodiment of the invention. For example, the tubing 14 can be drawn rather than extruded, and made from materials other than aluminum. Also, the stringing 26 can be secured to the frame 12 in ways other than that described, for example as described in UK Patent Application No. 82 00 722 (Publication No. 2 094 643).

We claim:

1. In a racquet having a handle, a string-supporting frame having two end portions which converge toward said handle and extend longitudinally therethrough, and a throat member disposed between the converging sections of said end portions, an improved handle structure comprising:

an internal handle member connected to said throat member, projecting into said handle between said end portions, and having a series of longitudinally arranged ratchet teeth; and an external handle member telescopingly received on said end portions, said external handle member having a series of longitudinally arranged ratchet teeth which are complementary to and cooperate with the ratchet teeth on said internal handle member and having space adjacent its ratchet teeth for receiving said end portions, whereby the handle is assembled by pushing said external handle member longitudinally onto said end portions so that said end portions extend into said space adjacent the ratchet teeth of said external handle member and said cooperating ratchet teeth progressively engage to lock the handle members together and firmly secure said throat member and said frame to the external handle member.

2. A racquet according to claim 1 wherein said internal handle member has two series of outwardly directed ratchet teeth on opposite sides thereof which face outwardly between said end portions, and said external handle member has two series of inwardly directed ratchet teeth which are complementary to and cooperate with said outwardly directed ratchet teeth.

3. A racquet according to claim 2 wherein said frame has an inwardly opening groove, and said throat member has projecting tabs which engage said groove in the converging sections of said end portions.

4. A racquet according to claim 3 wherein said external handle member has a pair of sockets adjacent the bottom end thereof for retaining the terminal ends of said end portions.

5. A racquet according to claim 2 wherein said external handle member has a pair of sockets adjacent the bottom end thereof for retaining the terminal ends of said end portions.

6. A racquet according to claim 2 wherein the two series of ratchet teeth of said internal and external handle members extend generally perpendicular to the plane of the racquet.

7. A racquet according to claim 1 wherein said frame has an inwardly opening groove, and said throat member has projecting tabs which engage said groove in the converging sections of said end portions.

8. A racquet according to claim 7 wherein said external handle member has a pair of sockets adjacent the bottom end thereof for retaining the terminal ends of said end portions.

9. A racquet according to claim 1 wherein said external handle member has a pair of sockets adjacent the bottom end thereof for retaining the terminal ends of said end portions.

10. A racquet according to claim 1 wherein the ratchet teeth of said internal and external handle members project generally away from the plane of the racquet.

* * * * *